US008602687B2

(12) United States Patent
Hubbell, Jr.

(10) Patent No.: US 8,602,687 B2
(45) Date of Patent: Dec. 10, 2013

(54) WATER/FLUIDS SURGE/BACKFLOW PROTECTION SYSTEMS AND MANAGEMENT

(76) Inventor: Paul J. Hubbell, Jr., Metairie, LA (US)

( * ) Notice: Subject to any disclaimer, the term of this patent is extended or adjusted under 35 U.S.C. 154(b) by 180 days.

(21) Appl. No.: 12/592,014

(22) Filed: Nov. 18, 2009

(65) Prior Publication Data

US 2010/0143037 A1 Jun. 10, 2010

Related U.S. Application Data

(60) Provisional application No. 61/199,428, filed on Nov. 18, 2008.

(51) Int. Cl.
*E02B 8/04* (2006.01)

(52) U.S. Cl.
USPC ..... 405/107; 405/80; 137/883

(58) Field of Classification Search
USPC ..... 405/80, 81, 83, 107, 108, 51, 37, 39, 405/40, 41; 137/883
See application file for complete search history.

(56) References Cited

U.S. PATENT DOCUMENTS

| | | | | |
|---|---|---|---|---|
| 914,399 | A * | 3/1909 | Fancher | 405/78 |
| 4,091,624 | A * | 5/1978 | Steinke | 405/96 |
| 4,324,506 | A * | 4/1982 | Steinke | 405/96 |
| 5,228,802 | A * | 7/1993 | Kuwabara et al. | 405/41 |
| 5,342,144 | A * | 8/1994 | McCarthy | 405/39 |
| 5,498,105 | A * | 3/1996 | Takada et al. | 405/80 |
| 6,102,618 | A * | 8/2000 | Takada et al. | 405/80 |
| 6,575,662 | B2 * | 6/2003 | French | 405/80 |
| 7,052,206 | B1 * | 5/2006 | Mastromonaco | 405/80 |
| 7,052,208 | B2 * | 5/2006 | Gardner | 405/80 |
| 7,798,175 | B2 * | 9/2010 | McBride | 405/80 |
| 2002/0146286 | A1 * | 10/2002 | Tsuchiya et al. | 405/107 |
| 2003/0066809 | A1 * | 4/2003 | Wang | 210/800 |
| 2006/0108294 | A1 * | 5/2006 | Kosanda et al. | 210/754 |
| 2006/0159519 | A1 * | 7/2006 | Schluter et al. | 405/39 |

* cited by examiner

*Primary Examiner* — Frederick L Lagman

(57) ABSTRACT

This design addresses the problems in areas below sea level adjacent to coastal communities with shallow canals/inlets with high tides/surges entering the discharge piping outlets arranged for normal average mean sea levels from pumping stations with outflow into a reservoir/body i.e., lake, river or waterway that is affected during storms, hurricanes or heavy rains driven by winds and high tides that render pumping inefficient at least and/or inoperable at worst. Included in this design is an inlet of a manifold connected to the pump's discharge, a normal discharge outlet and a second optional bypass discharge piping outlet, elevated over or through a high wall. Also included is automatic/manual shutoff valves and variable speed drive motor. The bypass discharge outlet includes, prior to the distal end, an ancillary piping arrangement that allows portions of the discharge flow directed back into underground aquifers for water table replenishment to aid subsidence maintenance.

11 Claims, 6 Drawing Sheets

WATER/FLUIDS SURGE/BACKFLOW PROTECTION SYSTEMS AND MANAGEMENT

REFERENCE TO RELATED DISCLOSURE

The present application includes and refers to the Provisional Patent Application No. 61/199,428 filed on Nov. 18, 2008; titled Water/Fluids Surge/Backflow Protection System And Methods.

TECHNICAL FIELD

The present invention initially relates to the existing designs and methods of operation and maintenance of pumping stations that attempt to regulate and control the discharge and outflow of drainage systems water collection caused by rainfall, tropical storms and/or hurricanes, to the interior lands within the levee protection system.

BACKGROUND ART

Pumping stations are used to drain storm waters from low lying land areas contained within a protective levee system and deposit those storm waters into lakes, bays, reservoirs, rivers, etc. outside of the protected levee system. Those waters outside of the levee protection system are usually subject to tidal fluctuations as well as storm surges. Most existing pumping stations in low elevation areas, especially in costal lands, rely on storm water being collected and transported via canals and/or waterways at or below sea levels and ground elevations with many such canals lined with elevated levees and/or floodwalls extending above ground level elevations. Under normal conditions, these type pumping stations rely on suction pumps to lift the accumulated storm waters and discharge said waters into the waterways outside of the protection levees.

The existing system/pumping stations are limited in their performance when abnormal amounts of storm waters are deposited for collection, removal/transferring to regions outside of the levee protection system, and when those regions themselves are inundated with high water levels due to high tides and wind driven surges resulting in backflow at the discharge outlet of the pumping/piping when rendered below workable sea level conditions.

Existing pumping stations usually have the discharge pipe outlets at or slightly above average sea level of the body receiving the discharge. So, when a high tide conditions prevail outside the protected levee system, especially when aggravated by storm surges with heavy rains and wind, the capability of the pumping process is diminished by the tide/surge and in severe conditions, pumping ceases.

Conventional methods of handling peak storm water flows rely on the use of storage basins to prevent localized flooding, especially in managing the run-off from disturbed areas into watersheds. For example, U.S. Pat. No. 7,052,206 to Mastromonoco teaches the use of a detention basin and a treatment basin with a bypass conduit to control peak storm water flows. Such systems intrinsically rely on gravity driven flow and are intended to slow the flow rates rather than increase them.

U.S. Pat. No. 6,575,662 discloses a water quality management system for exchanging water between two bodies of water at least partially separated by a barrier and including a series of dispersed pumps, each of which is connected to a water passage means extending through the barrier between the first and second body of water. The purpose of the system is to enhance the natural exchange of water between the two bodies in an effort to manage the water quality of the first body for marine life to flourish. This involves either pumping water from the second body into the first body or vice versa. That is, it is reversibly exchanging water between two bodies, but not primarily disposing of water from one body, and thereby lowering the water level of that body, and depositing in another. In one embodiment the pump is located on the land area of the barrier and thus is configured similar to a conventional pumping station used for removing storm waters. However this patent does not address situations or provide a solution for operation when the second body of water is experiencing storm surges.

SUMMARY OF THE INVENTION

It is the object of the present invention to solve the problem of the inability of pumping stations to effectively remove storm waters that are deposited in low lying land areas that are protected by levees. This inability arises when there is excessive rainfall producing flooding within the protected area and where the water level in the discharge bodies is unusually high as the result high tides and storm surges. Such conditions are often encountered in low-lying coastal areas where the discharge body is a stream, lake or bay connected to a large body of water such as a gulf, sea, or ocean. In the United States these conditions exist along parts of the Atlantic coast and the Gulf of Mexico. These same areas are subject to encounter severe hurricane weather events that are known to produce high tidal surges along the bays and estuaries that receive the discharged storm waters from the pumping stations. Failure of the pumping stations to adequately remove the accumulated storm waters from the levee-protected land areas has been known to result in loss of life and severe damage to property.

The object of the present invention is achieved by providing a pumping station with two discharge outlets into the receiving body. The first discharge outlet is for use in normal operating conditions and is positioned at an elevation just above the normal average high tide of the receiving body. The second discharge outlet is positioned vertically above first discharge outlet, the vertical separation being sufficient to discharge into the receiving body even when its water level is excessively high due to a storm surge. Diversion of the discharge flow from one outlet to the other is accomplished through the use of a by-pass valve assembly.

A second object of the present invention is to provide a pumping station that can discharge storm waters into a receiving body at two different vertical elevations, where the selected discharge elevation is activated by operating a by-pass valve which is remotely controlled.

A third object of the present invention is to provide a pumping station that can discharge storm waters into two different discharge outlets by using a by-pass valve, where one discharge outlet is a receiving body such as a river, lake, bay, etc., and the second discharge feeds the storm water into an underground aquifer.

MODES OF CARRYING OUT THE INVENTION

Figure 1:
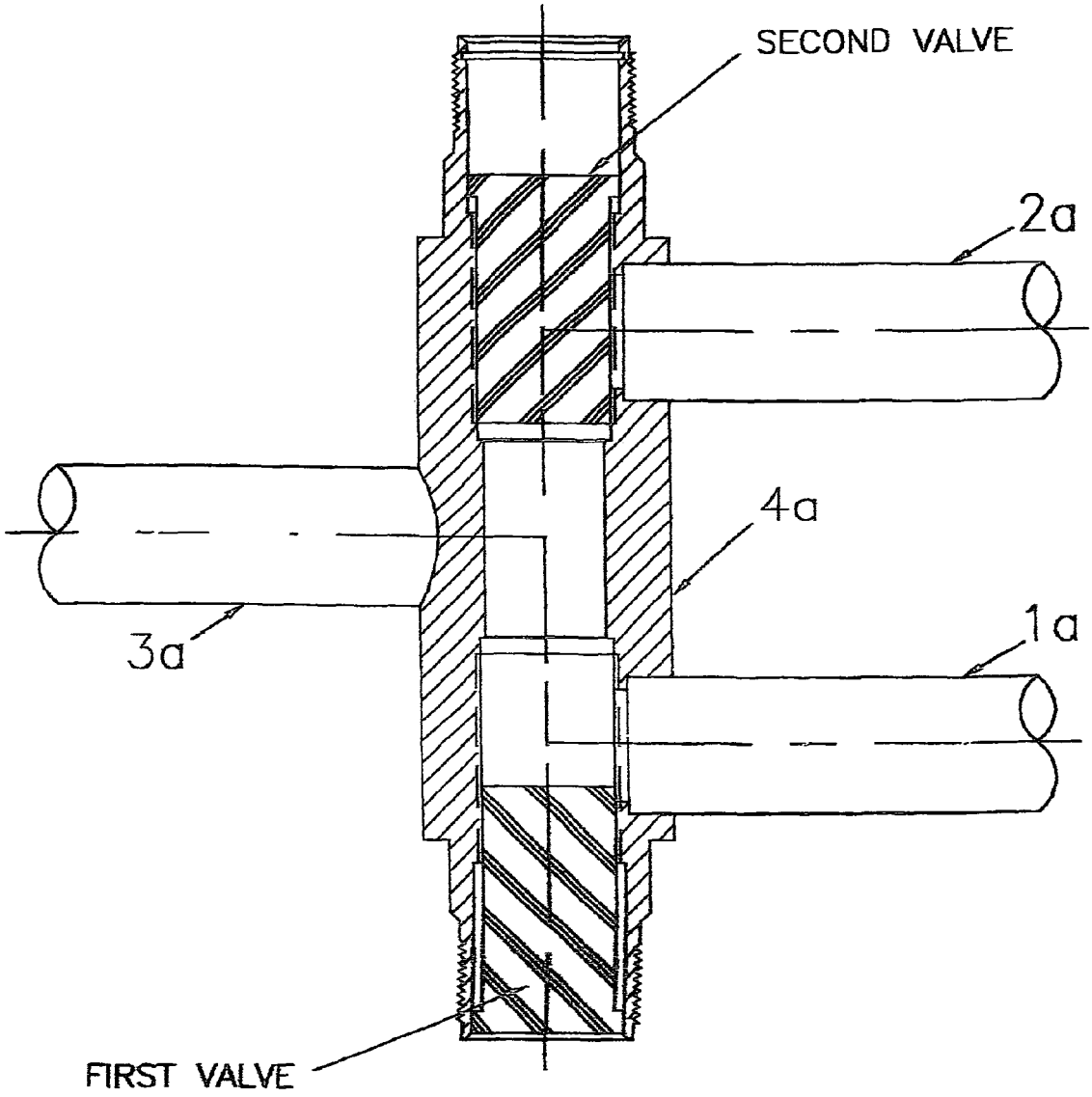
FIG. 1 illustrates a manifold cross section that incorporates a chamber/passageway with an inlet from a pump discharge, a first valve with discharge outlet and a second valve with a discharge by-pass outlet.

FIG. 1 illustrates a valve design of the type useful for implementing the objectives of this invention. It consists of a main manifold body 4*a*, with an internal chamber capable of communicating with discharge pipes 1*a* and 2*a*. A pump discharge pipe 3*a* also communicates with the internal chamber. The first valve, located at the bottom of FIG. 1, is normally open (back-seated) to the passageway chamber of manifold 4*a* which allows flow from the inlet 3*a* pump discharge pipe through outlet piping 1*a* into a waterway; the second valve, located at the top of FIG. 1, is closed (front-seated) to the outlet pipe 2*a*, thus preventing flow through outlet pipe 2*a*. This configuration is used for normal operation of the pumping station.

The valve system of FIG. 1 is operated by driving the first valve element up to block the flow through discharge port 1*a*, i.e., front-seating the first valve, while concurrently driving the second valve up to allow flow through discharge pipe 2*a*, i.e., back-seating the second valve. Likewise the reverse procedure returns the system to the initial configuration. The valve system operation may be performed manually or through automation with remote control using various motors, or hydraulics, and/or control electronics as is well known in the prior art. Such control methods allow the valve system to switch the flow through the system back and forth between the two outlet pipes.

FIG. 1 illustrates the normal operational state of the valve system during typical operational conditions where the flow is directed to the discharge pipe 1*a*. However, under conditions of stress such as heavy storm water accumulation in the area protected by the levees, along with high tides experienced by the discharge body resulting from storm surges, etc., the valve system is operated to redirect the flow to the discharge pipe 2*a*. When the tides return to normal levels, the valve system can be operated to return the flow through discharge pipe, 1*a*.

Figure 2:
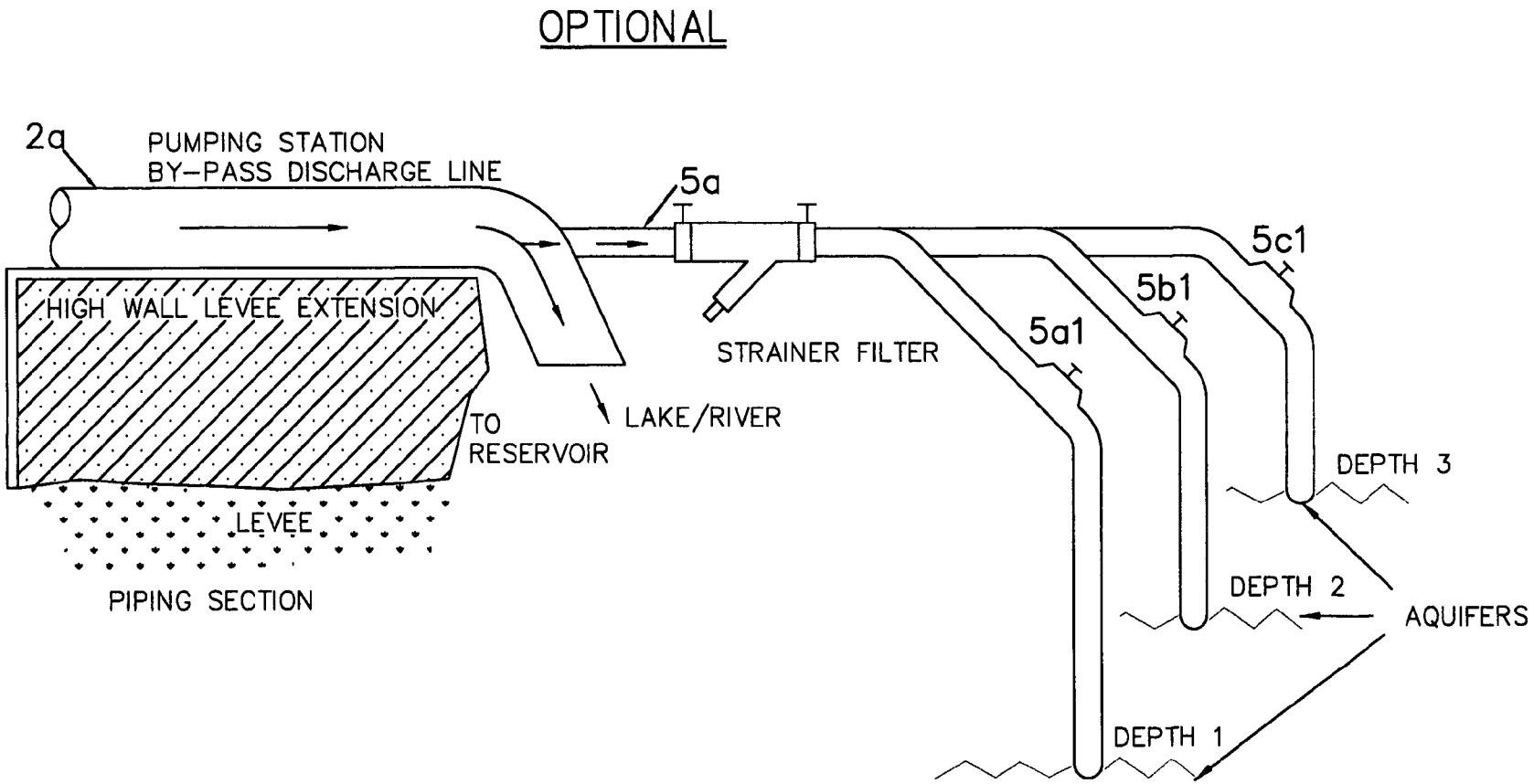
FIG. 2 depicts a second by-pass valve discharge outlet/piping elevated over a cross section of a levee with an extended high elevation flood wall including an optional ancillary piping scheme for aquifer recharging.

FIG. 2 depicts a second by-pass valve discharge outlet/piping elevated over a cross section of a levee with an extended high elevation flood wall including an optional ancillary piping scheme for aquifer recharging. This configuration allows all or a portion of the storm waters to be diverted into piping structures that communicate with underground aquifers.

The discharge line from the second valve 2*a* provides an ancillary tap off pipe 5*a* which feeds a strainer that includes shutoff valves on the inlet and outlet (for maintenance) and from this outlet feeds at least three additional take off lines 5*a*1, 5*b*1 and 5*c*1 branches that include throttling/shutoff valves to service a potential ground water aquifer for infusion to replenish the sinking water table which lends to subsidence. This function can also be utilized for exercising the infusion system during periods that do not require a normal bypass operation caused by high tides.

Figure 3A:
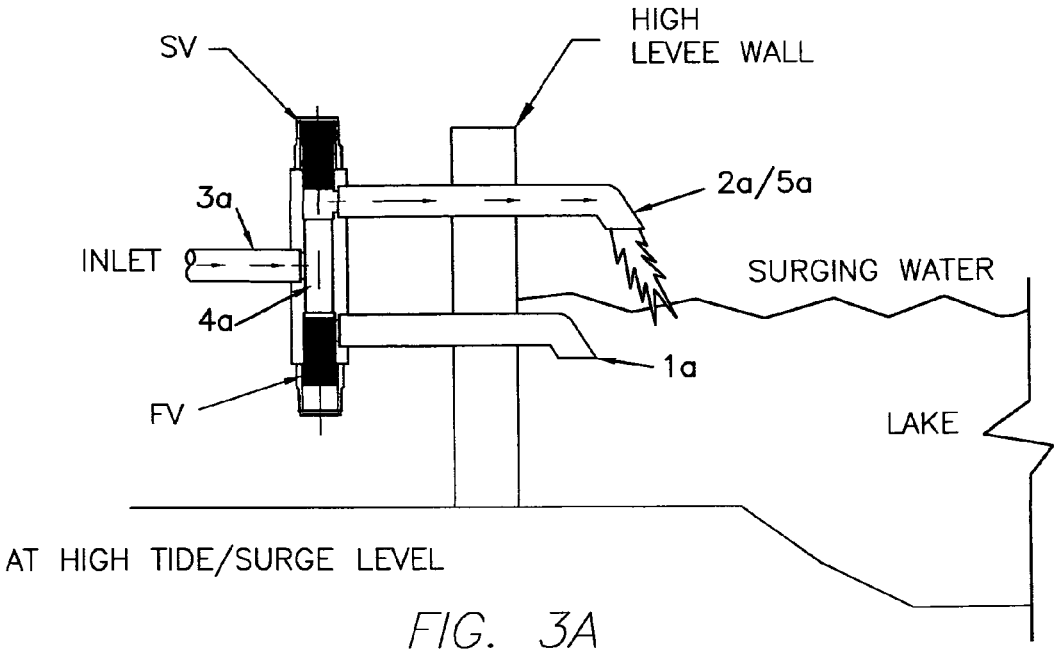
FIG. 3A illustrates the positions of the relative components of the pumping station discharge outlets at high tide surge levels for by-pass operation.
Figure 3:
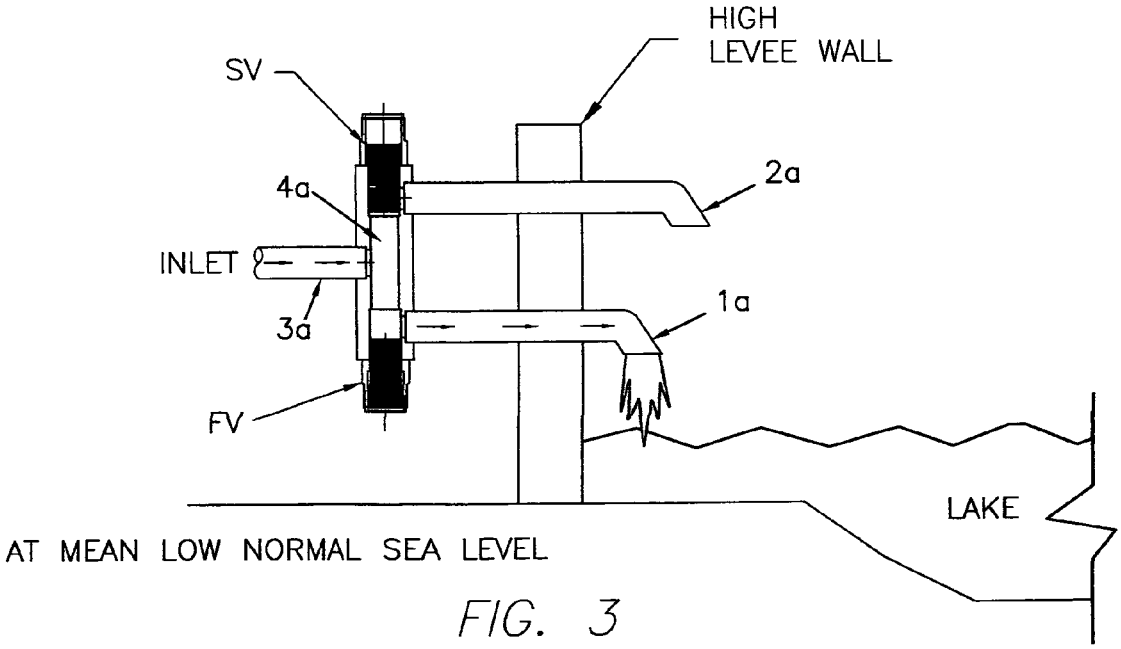
FIG. 3 shows position of pumping station discharge outlets at normal/mean low tide operational conditions.

FIG. 3 shows the normal position of the first valve (open) which allows flow through discharge piping 1*a* into the waterway at which time the second valve remains closed and no by-pass operation is required. In this figure the first valve FV is open and the second valve SV is closed.

FIG. 3A illustrates the positions of the relative components of the pumping station discharge outlets at high tide surge levels for by-pass operation. In this figure the first valve FV is closed and the second valve SV is open.

Figure 4:
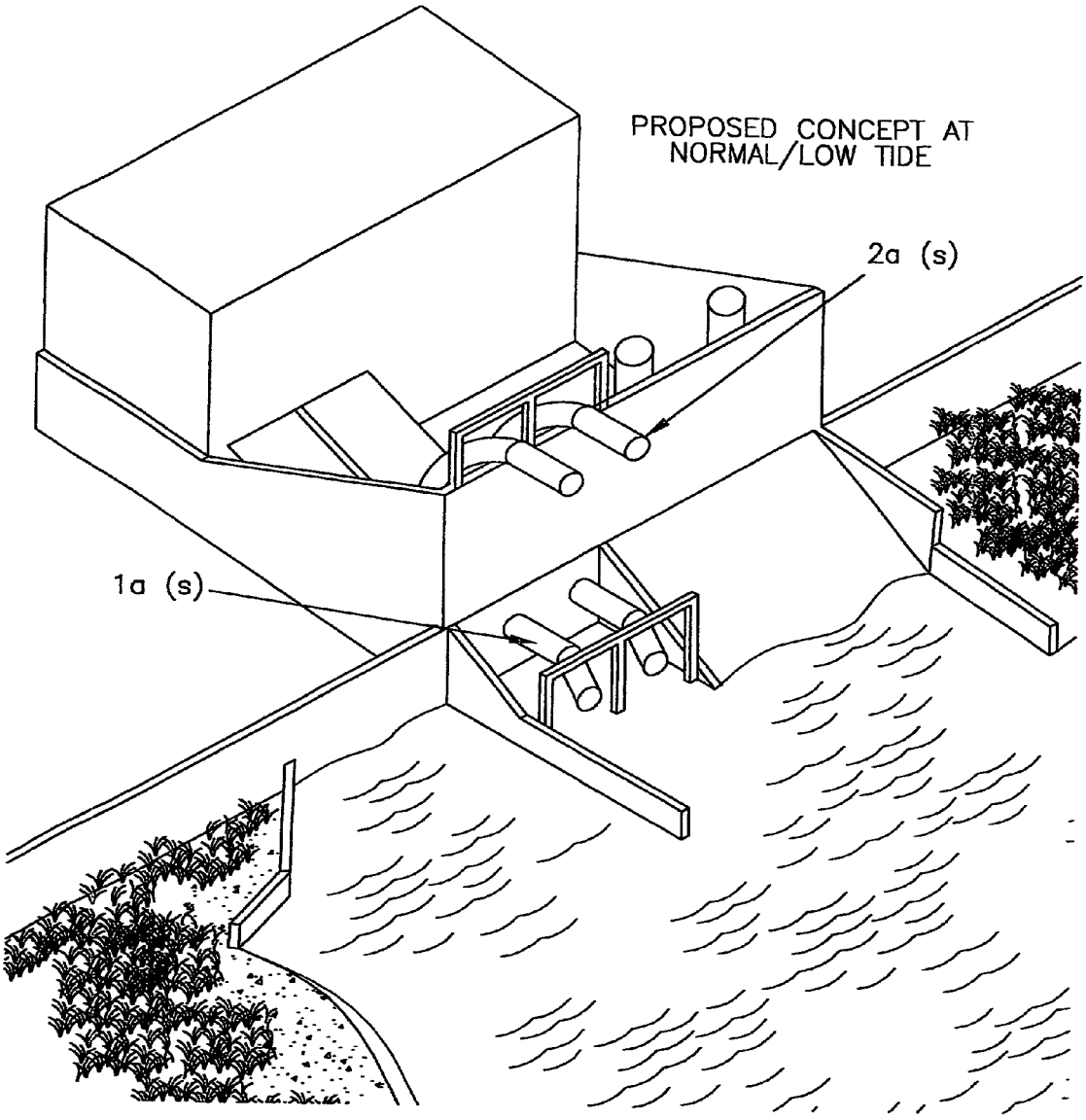
FIG. 4 schematically shows the discharge piping concept from pumps at mean low tides.

FIG. 4 shows an exterior view of a pumping station employing the valve system of FIG. 1-FIG. 3*a* illustrating the routing of the various discharge lines. There are two lower level discharge lines 1*a*(s) and two elevated discharge lines 2*a*(s). Each line 1*a* may be connected to the first valve in the same singular valve assembly or alternately may be connected to the first valve of identical, discrete valve assemblies. Likewise, each line 2*a* may be connected to the second valve in the same singular valve assembly or alternately may be connected to the second valve of identical, discrete valve assemblies. FIG. 4 depicts the normal, low tide operation where the flow is directed through discharge pipe(s) 1*a*.

Figure 5:
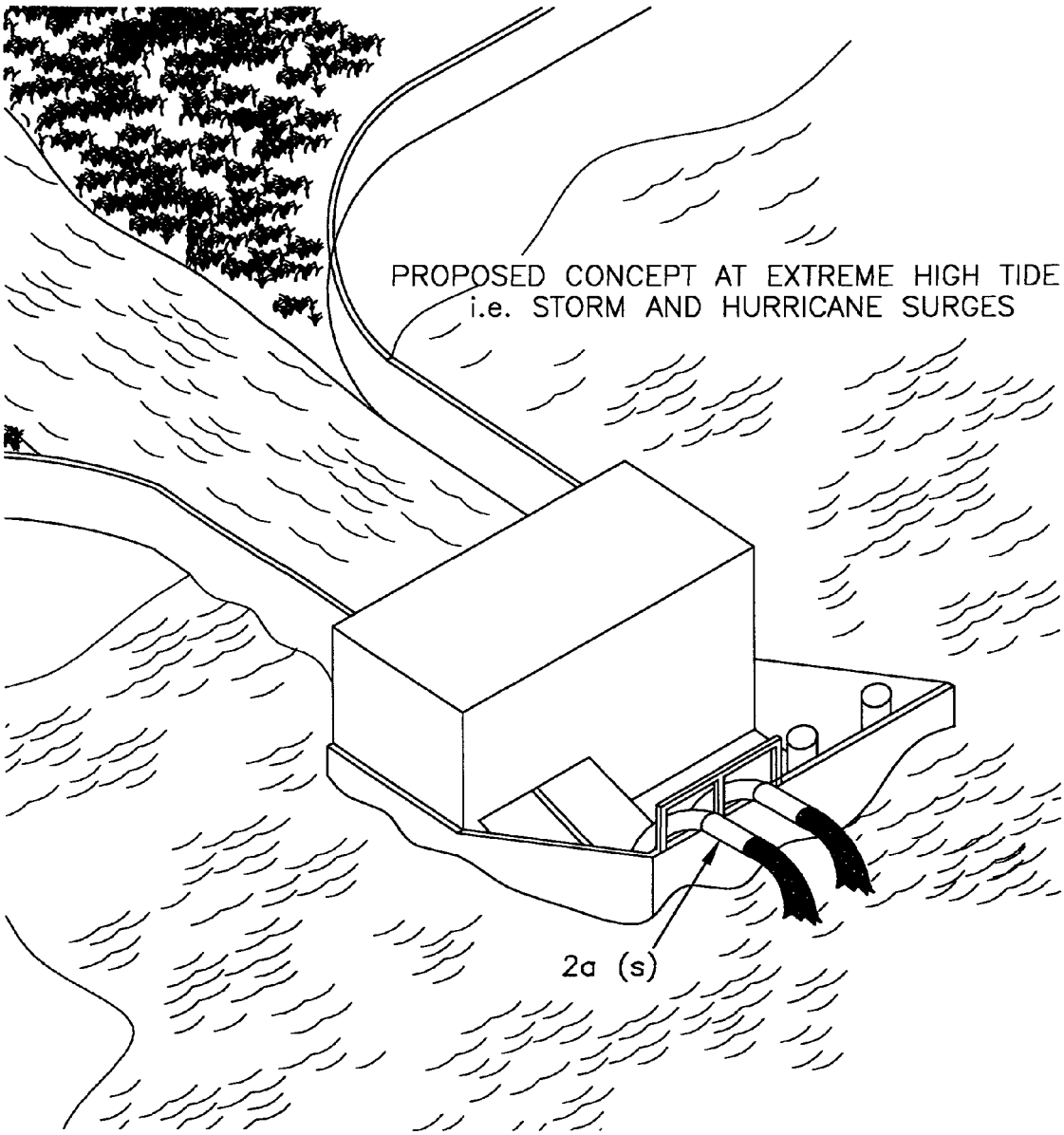
FIG. 5 illustrates use of by-pass piping discharge over high levee extension protective wall at high tide under storm surge condition.
Figure 6:
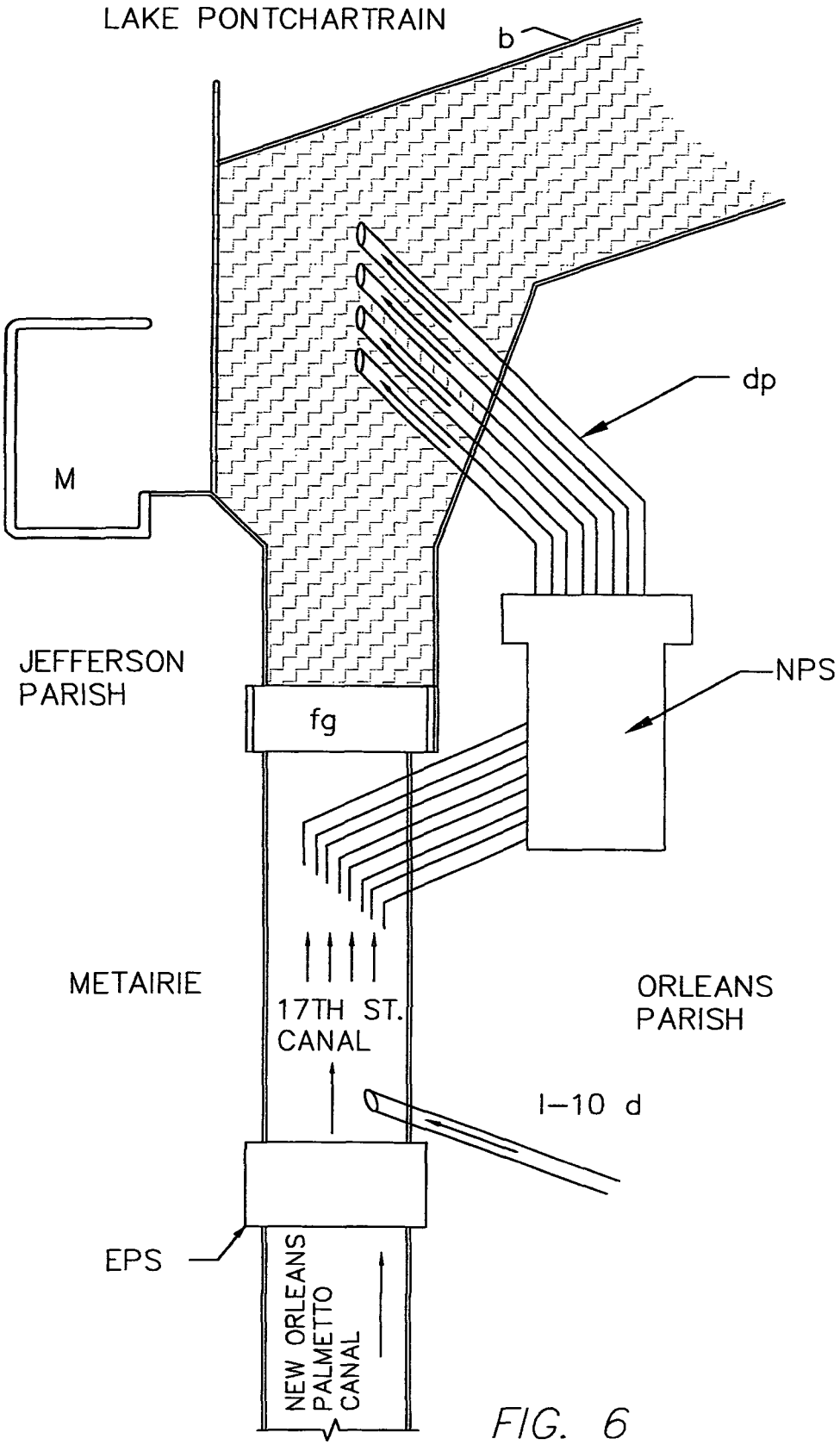

FIG. 5 shows another exterior view of a pumping station utilizing the valve system described in FIG. 1-FIG. 3*a*. In this instance the discharge body outside of the protective levee system (depicted here as barriers) is experiencing high tidal surge. Under this circumstance the valve system is operated to cause the discharged storm water to flow through discharge pipe(s) 2*a*.

A variable speed pump, as is known in the art, may be used to feed the input to the valve manifold described in FIGS. 1-3*a*. Said variable speed pump would operate at normal speed when discharging through the first valve at the lower elevation. Alternatively, the pump speed could be increased to provide the extra lift that might be needed to pump the flow through the second valve at the higher elevation. Said variable speed pump would provide for more efficient, energy saving operation.

While the invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims.

The invention claimed is:

1. A water drainage pumping station for transferring storm waters accumulated within a system of protective levees into a body of water outside the levee system, wherein the fluid discharged is not impeded by the backflow of water that results when the water level of the outside body is abnormally elevated due to storm surges or other high tide conditions, said pumping station comprising:

an intake port collecting waters from a drain system a within the area protected by the levee system, one or more pump(s) for transporting waters from the said intake port to a manifold, including valves for directing the outflow from the pump(s) to selected discharge ports, a first discharge port for discharging into an outside body of water when said body is not experiencing abnormally high water levels, a second bypass discharge port, said second discharge port elevated relative to the first discharge port, for discharging into the outside body of water when said body of water is experiencing abnormally high water levels and producing backflow against the pump(s).

2. The water drainage pumping system of claim 1 wherein the valves of the manifold are operated manually.

3. The water drainage pumping system of claim 1 wherein the valves of the manifold are operated automatically and are regulated by water pressure levels.

4. The water drainage pumping system of claim 1 wherein the second discharge port is elevated to a height above the first discharge port so that it will not be subject to high tides and surges.

5. The water drainage pumping system of claim 1 wherein the second discharge port is connected to piping for injecting the drainage water into wells or aquifers.

6. The water drainage pumping system of claim 5 wherein the drainage water is filtered and treated before injecting into wells or aquifers.

7. The water drainage pumping system of claim 1 wherein the input port consists of a plurality of portals piping the inflow to the pump(s).

8. The water drainage pumping system of claim 1 wherein the first discharge port consists of a plurality of portals piping the outflow from the manifold into the outside body of water.

9. The water drainage pumping system of claim 1 wherein the second discharge port consists of a plurality of portals piping the outflow from the manifold into the outside body of water.

10. The water drainage pumping system of claim 1 wherein the pump(s) is driven by a fuel engine or electric motor.

11. The water drainage pumping system of claim 1 wherein the pump(s) speed is variable, as well as an energy saving device.

* * * * *